United States Patent [19]

Yamazaki et al.

[11] Patent Number: 5,075,949

[45] Date of Patent: Dec. 31, 1991

[54] METHOD OF MANUFACTURING SLIDE FASTENERS

[75] Inventors: Makoto Yamazaki, Kurobe; Kazuki Kuse, Toyama; Tatsuo Ito, Kurobe, all of Japan

[73] Assignee: Yoshida Kogyo K. K., Tokyo, Japan

[21] Appl. No.: 701,846

[22] Filed: May 17, 1991

[30] Foreign Application Priority Data

May 19, 1990 [JP] Japan ..... 2-129945

[51] Int. Cl.[5] ..... B21D 53/50

[52] U.S. Cl. ..... 29/408; 29/712; 29/766

[58] Field of Search ..... 29/408, 766–768, 29/712, 33.2

[56] References Cited

U.S. PATENT DOCUMENTS 4,625,375 12/1986 Osaki ..... 29/408

4,932,113 6/1990 Frohlich et al. ..... 29/409

FOREIGN PATENT DOCUMENTS 274205 3/1990 Japan .

*Primary Examiner*—P. W. Echols

*Attorney, Agent, or Firm*—Hill, Van Santen, Steadman & Simpson

[57] ABSTRACT

A method is disclosed for manufacturing slide fasteners from a single homogeneous elongate stringer chain or a stringer chain comprising a plurality of interconnected stringer chains of different characteristics having first standard element-devoid space portions. The method comprises marking the stringer chain at spaced apart locations by providing second element-devoid space portions greater in length than the first standard space portions and detecting the second space portions to trigger operation of respective operative units in the manufacturing apparatus.

5 Claims, 4 Drawing Sheets

METHOD OF MANUFACTURING SLIDE FASTENERS

BACKGROUND OF THE INVENTION

1. Field of the Invention

This invention relates to a method of manufacturing slide fastener products from an elongate continuous stringer chain and more particularly such a method which enables selective production of slide fasteners of different types, lengths and/or colors during a continuous automatic cycle of operation.

2. Prior Art

There are known certain methods of manufacturing slide fasteners from a continuous stringer chain without interrupting or shutting down the production line. A typical example of such method is disclosed in Japanese Patent Laid-Open Publication No. 2-74205 which teaches marking a stringer chain at certain intervals or at defective portions by punching holes which serve as a means of controlling the operation of each of the parts applying units in a slide fastener manufacturing apparatus. Such prior art method has a difficulty in that the punched out holes Ph (FIG. 10) are prone to get plugged up or otherwise marred by dusts, frayed yarns of the stringer tapes, or other foreign matters, resulting in inaccurate detection of the marks which is usually optically performed.

SUMMARY OF THE INVENTION

With the foregoing difficulties of the prior art in view, the present invention seeks to provide an improved method of manufacturing slide fasteners which will ensure accurate detection of control marks on an elongate stringer chain so as to enable its component parts such as top and bottom end stops, sliders and the like to be assembled selectively substantially in a continuous integrated cycle of operation.

The invention further seeks to provide an improved method of manufacturing slide fasteners which will make it possible to produce slide fastener products of different forms, sizes and/or colors from a single continuous elongate stringer chain or a plurality of interconnected stringer chains.

The invention also seeks to provide an improved method of manufacturing slide fasteners of the character described in which there is provided a means of detecting the control marks without fail to trigger operation of the respective parts applying units.

These and other objects and features of the invention will become manifest from reading the following detailed description with reference to the accompanying drawings.

According to the invention, there is provided a method of manufacturing slide fasteners which comprises the steps of gapping an elongate continuous stringer chain to provide first element-devoid space portions having a standard length at predetermined intervals therealong; selectively feeding and applying various slide fastener component parts onto the stringer chain; and cutting the stringer chain across the element-devoid space portions into individual slide fastener products, an improved method comprising: forming a control mark consisting of a second element-devoid space portion having a length greater than that of the first element-devoid space portion at locations spaced apart by predetermined distances along the length of the stringer chain; and detecting the control mark on the stringer chain in advance of each of the steps by means of a detector having an operating length substantially equal to the length of the control mark.

DETAILED DESCRIPTION OF THE INVENTION

Figure 1:
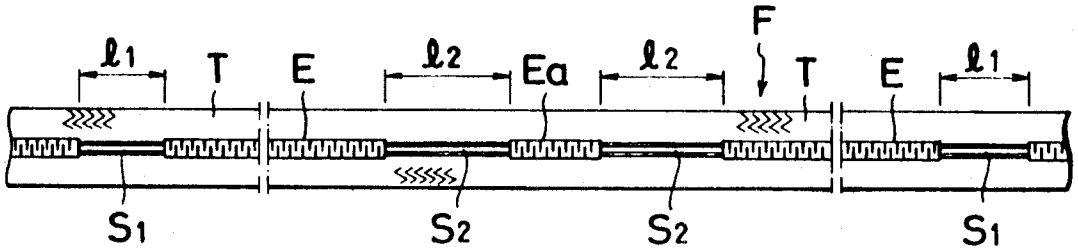
FIG. 1 is a segmentary plan view of a single elongate stringer chain to be processed.

Referring now to the drawings and FIG. 1 in particular, there is shown a single continuous stringer chain F which comprises a pair of the same kind of stringer tapes T, T and a row of the same kind of coupling elements E mounted thereon and gapped to provide element-devoid space portions at predetermined intervals.

A first space portion $S_1$, hereinafter referred to as a standard space portion, has a standard length $l_1$ normally adopted for determining a given product length of an individual slide fastener. The first space portion $S_1$ is formed by removing a corresponding length of a row of interengaged coupling elements E from the tapes T, T at locations spaced apart by predetermined distances along the length of the chain F by means of a gapping device 11 shown in FIG. 7 which essentially comprises a punch 11*a* and a die anvil 11*b*, the punch 11*a* having an operating length corresponding to the standard space portion $S_1$.

A second space portion $S_2$, hereinafter referred to as a control mark, has a length $l_2$ greater than that $l_1$ of the standard space portion $S_1$ and hence can be formed by the same gapping device 11; that is, by actuating the punch 11*a* twice or thrice to provide the space length $l_2$ at locations spaced a predetermined distance apart along the length of the chain F. In the embodiment shown in FIG. 1, there are two neighboring control marks $S_2$, $S_2$ spaced apart from each other longitudinally of the stringer chain F across a demarcating element zone Ea formed by a predetermined length of a row of coupling elements E.

Figure 2:
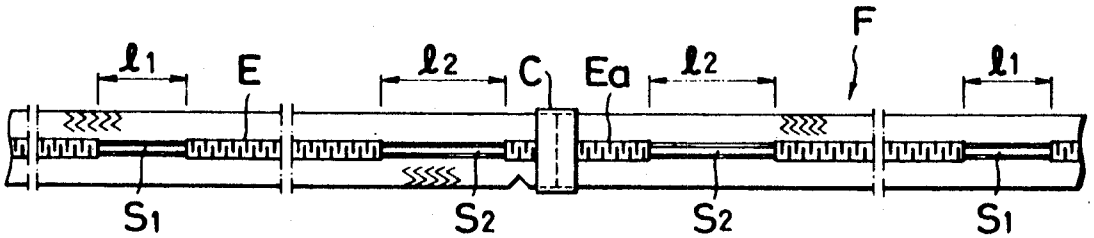
FIG. 2 is a view similar to FIG. 1 but showing a plurality of interconnected stringers.

In the embodiment shown in FIG. 2, the two neighboring control marks $S_2$, $S_2$ are spaced apart across a connecting strip C spanning the width of the tapes T, T, and interconnecting adjoining stringer tapes T, T which are different in for instance color, size and/or material.

When changing the lengths or styles of individual slide fasteners to be produced from a single homogeneous stringer chain, this may be done with a single control mark $S_2$ consisting of a space portion longer than the standard first space portion $S_1$ and located where such change is desired.

Figure 3:
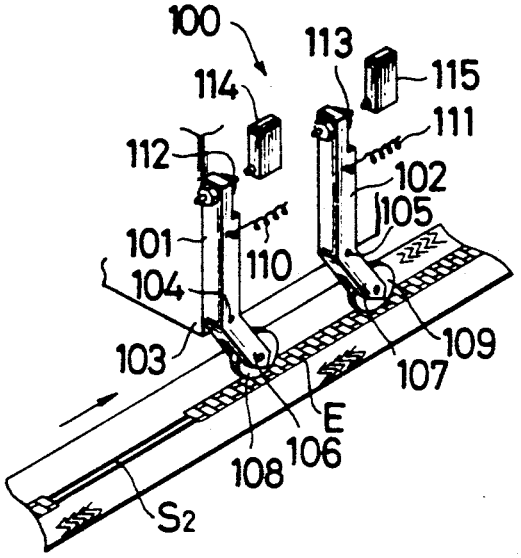
FIG. 3 is a diagrammatic perspective view of a marking means provided in accordance with the invention.

FIG. 3 shows a control mark detector 100 which comprises a pair of vertically disposed first and second levers 101 and 102 which are mounted on a carrier 103 in spaced apart relation longitudinally of the stringer chain F and pivotable about their respective pins 104 and 105. Each of the levers 101 and 102 has a shank 106, (107) at its lower end and a probing roll 108, (109) rotatably connected thereto. Springs 110 and 111 are connected to the upper portions of the respective levers 101 and 102 and adapted to normally urge the respective rolls 108 and 109 against the interengaged rows of coupling elements E. Designated at 112 and 113 are projecting lugs extending laterally from the upper ends of the respective levers 101 and 102 and adapted to engage respective microswitches 114 and 115 when the probing rolls 108 and 109 are brought into engagement with the second space portion or control mark $S_2$ in a manner hereinafter described.

Figure 4:
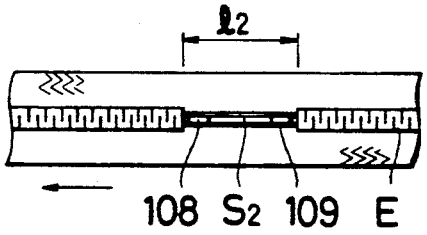
FIGS. 4, 5 and 6 inclusive are segmentary views utilized to explain the operating relation of the detecting means relative to the stringer chain.

The levers 101 and 102 are spaced from each other by a distance corresponding to the length $l_2$ of the control mark $S_2$ such that both of the microswitches 114 and 115 are actuated when both of the two rolls 108 and 109 are simultaneously located in and at the control mark $S_2$ as shown in FIG. 4. With advancing movement of the chain F, the probing roll 108 of the first lever 101 reaches the control mark $S_2$, causing the lever 101 to make a pivotal movement about the pin 104 and hence the lug 112 to contact the microswitch 114. A similar action is followed by the second lever 102. And, as both of the rolls 108 and 109 come into engagement with the control mark $S_2$, both microswitches 114 and 115 are turned on simultaneously, whereupon a parts applying unit immediately downstream of the detector 100 is triggered to perform its work according to a computer program which has been compiled to effect a predetermined mode of operation of the apparatus.

An optical detection means may be alternatively used to detect the control mark $S_2$.

Figure 5:
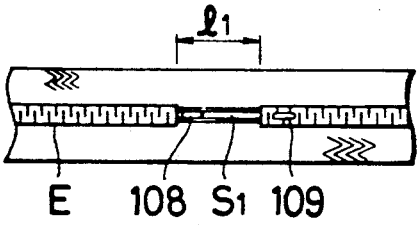
Figure 6:
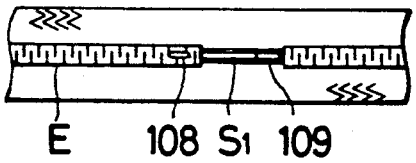

FIGS. 5 and 6 illustrate a stringer chain F having a standard space portion $S_1$ smaller in length than the control mark $S_2$. Due to the standard space portion $S_1$ being shorter, there is no instance in which the two rolls 108 and 109 are located simultaneously in and at the control mark $S_2$ to actuate the two microswitches 114 and 115 at the same time. Therefore, there is no risk of erroneous detection of the control mark $S_2$, or malfunction of the apparatus.

Figure 7:
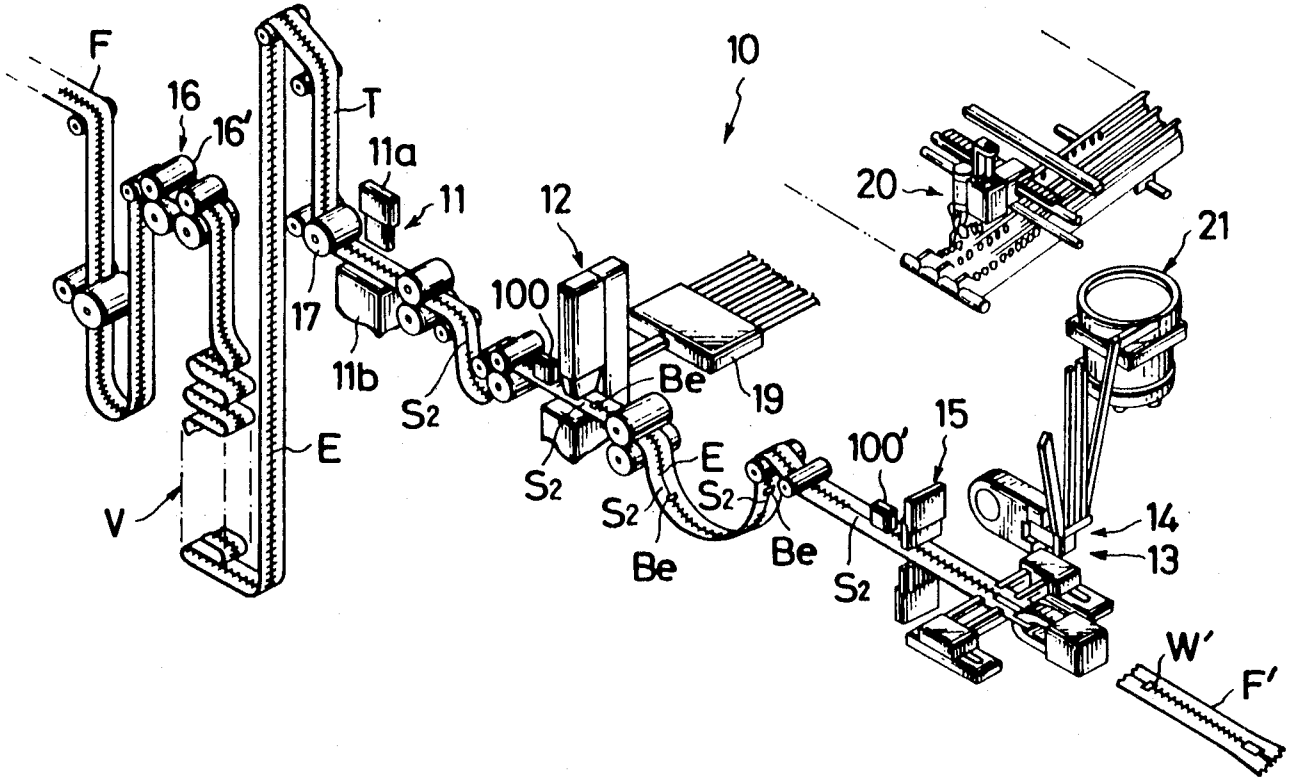
FIG. 7 is a diagrammatic perspective view utilized to illustrate the overall process steps involved in the manufacture of slide fasteners according to the invention.

Turning to FIG. 7, there is shown an overall assembling apparatus 10 for manufacturing slide fasteners of different product characteristics from the stringer chain F. The apparatus 10 comprises a gapping unit 11, a bottom end stop applying unit 12, a slider applying unit 13, a top end stop applying unit 14, and a cutting unit 15.

The starting stringer chain F supplied from a source not shown is metered by a metering roll assembly 16 which meters the length of the chain F by counting the number of revolutions for instance of a roll 16', and the feeding of the stringer chain F is arranged to stop upon completion of a predetermined number of revolutions of the roll 16'. A reserve vessel V is provided for storing a plurality of stringer chains F of different sizes and product characteristics which have been metered and fed from the metering assembly 16. The chain F is advanced by feed rolls 17 into the gapping unit 11, which essentially comprises a punch 11*a* and a die anvil 11*b* disposed in confronting relation to each other, and gapped at a predetermined position to remove a length of coupling elements E thereby providing the first or standard element-devoid space portion $S_1$ as well as the second space portion or control mark $S_2$ at predetermined intervals as already described.

Figure 8:
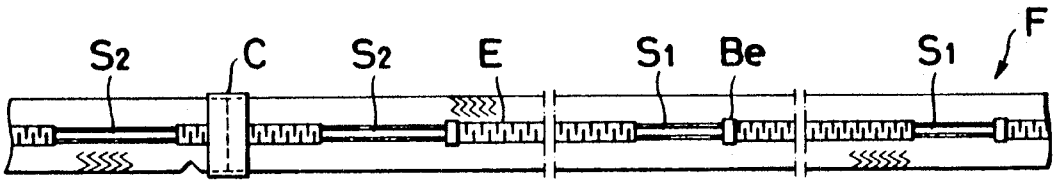
FIG. 8 is a segmentary plan view of a stringer chain assembled with bottom end stops.
Figure 9:
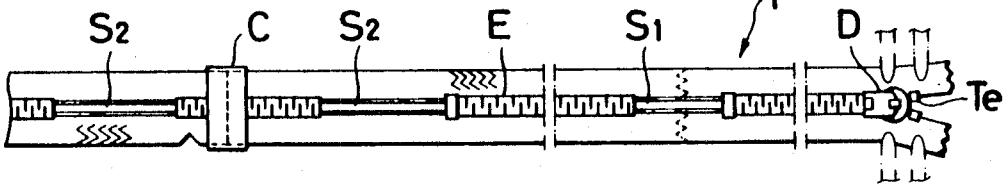
FIG. 9 is a view similar to FIG. 8 but showing the stringer chain further assembled with sliders and top end stops.
Figure 10:
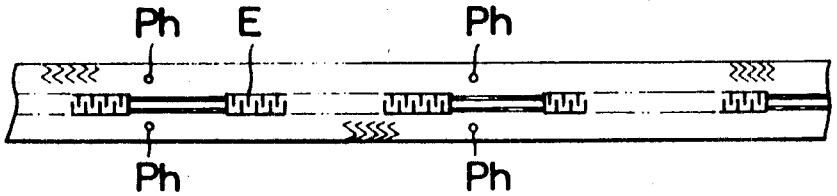
FIG. 10 is a segmentary plan view of a stringer chain having punched-out holes according to a prior art method.

The control mark detector 100 is located upstream of the bottom end stop applying unit 12 and adapted to detect the control mark $S_2$ in a manner described hereinabove, thereby triggering operation of a bottom end stop feeder 19 to supply a new or selected set of end stops Be differring in form and/or color from a previous inventory of end stops. The stringer chain F, upon attachment with the end stop Be as shown in FIG. 8, continues to advance until the control mark $S_2$ is detected by another detector 100' upstream of the cutting unit 15, whereupon the subsequent slider and top end stop applying units 13 and 14 are triggered to apply a new or selected slider D and top end stop Te from a slider feeder 20 and a top end stop feeder 21, respectively in a manner well known in the art and as shown in FIG. 9. The stringer chain F thus assembled is cut by the cutter 15 across the standard space portion $S_1$ to provide an individual slide fastener product F' as shown in FIGS. 9 and 7. The apparatus 10 has been disclosed in detail in the copending U.S. patent application Ser. No. 550,078 and European Patent Application No. 90113291.0 and hence no further explanation herein is warranted.

Obviously, various modifications and variations of the present invention are possible in the light of the above teaching. It is therefore to be understood that within the scope of the appended claims the invention may be practiced otherwise than as specifically described.

What is claimed is:

1. In a method of manufacturing slide fasteners which comprises the steps of gapping an elongate continuous stringer chain to provide first element-devoid space portions having a standard length at predetermined intervals therealong; selectively feeding and applying various slide fastener component parts onto said stringer chain; and cutting said stringer chain across said element-devoid space portions into individual slide fastener products, an improved method comprising:

forming a control mark consisting of a second element-devoid space portion having a length greater than that of said first element-devoid space portion at locations spaced apart by predetermined distances along the length of said stringer chain; and detecting said control mark on said stringer chain in advance of each of said steps by means of a detector having an operating length substantially equal to the length of said control mark.

2. The method claimed in claim 1 wherein a plurality of said control marks are spaced apart from each other across a demarcating element zone formed by a predetermined length of a row of coupling elements.

3. The method claimed in claim 1 wherein a plurality of said control marks are spaced apart from each other across a connecting strip interconnecting adjoining stringer chains.

4. The method claimed in claim 1 wherein said stringer chain is a single continuous elongate stringer chain of the same characteristics.

5. The method claimed in claim 1 wherein said stringer chain comprises a plurality of interconnected stringer chains of different characteristics.

* * * * *